US008075820B2

(12) United States Patent
Willemsen et al.

(10) Patent No.: US 8,075,820 B2
(45) Date of Patent: Dec. 13, 2011

(54) METHOD FOR IMPROVING FILAMENT COHESIVENESS OF CHOPPED ARAMID FIBER

(75) Inventors: Stephanus Willemsen, Rheden (NL); Hendrik Berend Olde, Emmen (NL)

(73) Assignee: Teijin Aramid B.V., Arnhem (NL)

( * ) Notice: Subject to any disclaimer, the term of this patent is extended or adjusted under 35 U.S.C. 154(b) by 116 days.

(21) Appl. No.: 11/922,590

(22) PCT Filed: Jul. 1, 2006

(86) PCT No.: PCT/EP2006/006419

§ 371 (c)(1),
(2), (4) Date: Jan. 18, 2008

(87) PCT Pub. No.: WO2007/006438

PCT Pub. Date: Jan. 18, 2007

(65) Prior Publication Data

US 2008/0251965 A1 Oct. 16, 2008

(30) Foreign Application Priority Data

Jul. 8, 2005 (EP) ..... 05014815

(51) Int. Cl.

| | |
|---|---|
| ***B29C 67/00*** | (2006.01) |
| ***B29B 9/14*** | (2006.01) |
| ***D01F 11/08*** | (2006.01) |
| ***D06M 15/564*** | (2006.01) |
| ***D06M 15/507*** | (2006.01) |

(52) U.S. Cl. ..... 264/103; 264/136; 264/140

(58) Field of Classification Search ..... 264/134, 264/135, 136, 17, 138, 140, 152, 137, 103, 264/130, 143, 148

See application file for complete search history.

(56) References Cited

U.S. PATENT DOCUMENTS

| | | | | |
|---|---|---|---|---|
| 4,455,341 | A | 6/1984 | Harteman | |
| 5,227,238 | A | 7/1993 | Hirai et al. | |
| 5,622,771 | A * | 4/1997 | Chiou et al. | 428/219 |
| 6,407,017 | B1 * | 6/2002 | Wada et al. | 442/335 |
| 6,423,227 | B1 * | 7/2002 | Allen et al. | 210/497.1 |
| 6,444,187 | B1 * | 9/2002 | Miyoshi et al. | 423/447.2 |
| 6,660,336 | B1 * | 12/2003 | Frenken et al. | 427/379 |
| 7,053,344 | B1 * | 5/2006 | Surjan et al. | 219/549 |
| 2002/0100635 | A1 * | 8/2002 | Inoue et al. | 181/167 |
| 2003/0022961 | A1 * | 1/2003 | Kusaka et al. | 523/152 |
| 2004/0180185 | A1 * | 9/2004 | Fujimori et al. | 428/297.4 |
| 2005/0009428 | A1 * | 1/2005 | Porter et al. | 442/129 |

FOREIGN PATENT DOCUMENTS

| | | | |
|---|---|---|---|
| JP | 63011308 | A * | 1/1988 |
| JP | 02019531 | A * | 1/1990 |
| JP | 04050377 | A * | 2/1992 |
| JP | 08174689 | A * | 7/1996 |
| JP | A-10-235641 | | 9/1998 |
| SU | 1669945 | A1 | 8/1991 |

OTHER PUBLICATIONS

SU 1669945 A1 English translation; Cherkasova et al.; Aug. 1991.*
Translation of Ito, JP 63-011308 A, Jan. 1988.*
Translation of Kuribayashi, JP 04-050377 A, Feb. 1992.*

* cited by examiner

*Primary Examiner* — Joseph Del Sole
*Assistant Examiner* — Ryan Ochylski
(74) *Attorney, Agent, or Firm* — Oliff & Berridge, PLLC

(57) ABSTRACT

The invention pertains to a method for improving filament cohesiveness of chopped aramid fiber including the steps of impregnating a film-forming binding agent into the fiber, drying the fiber, optionally applying a finish to the fiber, and chopping the fiber to pieces of 1 to 16 mm length, characterized in that the fiber prior to applying the binding agent is subjected to a twisting process to obtain a fiber having a twisting level of 10 to 150 tpm and that the chopping of the fiber is performed in a rotary chopper.

6 Claims, No Drawings

METHOD FOR IMPROVING FILAMENT COHESIVENESS OF CHOPPED ARAMID FIBER

BACKGROUND

The invention relates to a method for improving filament cohesiveness of chopped aramid fiber.

Thermoplastic pre-compounds filled with aramid fibers (generally, up to 20%) and in the form of granules are frequently used as basic material for the manufacturing, for instance by an injection-molding process, of composite articles (e.g. gears, bearings) with an improved resistance to abrasion. These pre-compounds are produced by mixing thermoplastic matrix material as chips with chopped aramid fibers via a melt extrusion process. To that end, the thermoplastic chips and the chopped aramid fibers are separately dosed into the throat of an extruder. A serious problem of feeding fibers into the extruder is the forming of bridges and lumps of fiber, hampering smooth and fast introduction into the extruder. It appears that single filaments that are not longer bound in the chopped pieces of fiber, are agglomerating into fuzz balls, which lead to lumps, bridging, and clogging of the transport systems.

It is therefore an object of the present invention to provide a method for obtaining chopped fibers that do not have these disadvantages. Thus the present method provides in granule like chopped fibers, i.e. fibers wherein the cohesiveness of the filaments of one fiber is improved which results in a behavior as if the fiber is one big monofilament. It is however, not possible to alleviate the above-mentioned disadvantages by applying improved binding agents or the like, because this does not lead to a substantially improvement of the filament bundle cohesion.

SUMMARY

To this end the invention provides a method for improving filament cohesiveness of chopped aramid fiber including the steps of impregnating a film-forming binding agent into the fiber, drying the fiber, optionally applying a finish to the fiber, and chopping the fiber to pieces of 1 to 16 mm length, characterized in that the fiber prior to applying the binding agent is subjected to a twisting process to obtain a fiber having a twisting level of 10 to 150 tpm and that the chopping of the fiber is performed in a rotary chopper.

Surprisingly, it was found that such twisting step prior to rotary chopping for preparing chopped fibers substantially increased the filament cohesiveness, which makes it possible to prevent fully or almost fully the occurrence of free, filaments agglomerating into fuzz balls. The effect of this method therefore is a substantial increase of the bulk density of the fiber material. Increased bulk density corresponds to increased ease of feeding the material into an extruder.

The method of the invention is unknown for aramid fibers. According to U.S. Pat. No. 5,227,238 carbon fibers have been chopped and most preferably provided with from 10 to 20 twists per meter, to obtain a chopped carbon fiber having a better bundling degree. It was however not disclosed to use a rotary chopper for increasing the bulk density.

The aramid fibers according to the invention are twisted, a very common process in fiber technology for which the skilled person does not need further explanation, to a twisting level of at least 10 tpm (turns per meter) and not more than 150 tpm. Better results are obtained when the twisting level is 20 to 100 tpm, and most preferably 30 to 80 tpm. These twisted fibers are more or less round, this geometry is fixated by the sizing on the fibers which after cutting leads to round or elliptically shaped (in cross section) chopped fibers, rather than flat ones as is the case when applying the prior art. It is believed that these round or elliptical shaped chopped fibers further contribute to the ease of handling thereof.

DETAILED DESCRIPTION

After the twisting step, which is the essential step to obtain at the end improved chopped fibers, the fiber is treated with a film-forming binding agent and optionally an overlay finish. The binding agent further improves the interfilament cohesion and should be a film-forming polymer which melts in the extruder. Preferably, the binding agent is water-soluble or water-dispersible, such as a polyurethane and/or sulfonated polyester resin.

Examples of suitable polyesters are polymers derived from a sulfonated dicarboxylic acid, a dicarboxylic acid and a diol. Preferred is polyester derived from dimethyl sodium sulfoisophthalic acid, isophthalic acid and ethylene glycol. Such a product is available under the trade name Eastman® LB-100. Examples of suitable polyurethanes are polyether-polyurethane or polyester-polyurethane dispersions, available under the trade names Alberdingk® U400N and Impranil® DLF, respectively. Suitable amounts of binding agent are between 1.5 and 12 wt. %, preferably 2.0 to 9 wt. %, and with even more preference 2.5 to 6 wt. %. When the binding agent is applied as an aqueous solution or dispersion, the fiber should be dried after the application of the binding agent, for instance over drum dryers, air dryers, and the like.

The overlay finish, when used, is a low intrinsic viscosity oil, which reduces the friction of the treated yarn and of the chopped fiber with guide rollers of the cutting unit and metal parts of the transport system to the extruder, respectively. Preferably, the overlay finish is an ester oil used in an amount of 0.05 to 3 wt. %, more preferably from 0.1 to 1 wt. %. Examples of suitable oils are 2-ethyl hexyl stearate, 2-ethyl hexyl palmitate, n-butyl laurate, n-octyl caprylate, butyl stearate or mixtures thereof. Preferred-ester oil is a mixture of 2-ethyl hexyl stearate and 2-ethyl hexyl palmitate, which is available under the trade name LW® 245.

The fibers when treated with the binding agent, dried, and optionally further provided with a finish are chopped in pieces of 1 to 16 mm, preferably 2 to 12 mm, and more preferably in pieces of 3 to 10 mm. Chopping is performed with a rotary chopper. The rotary chopper has the additional advantage that it is more efficient, making the process more economic and giving less or no waste material. Any other common chopper that is suitable for chopping aramid fibers, such as a guillotine chopper, although also giving an increase of the bulk density does not lead to the extreme high bulk densities of the method of this invention.

It was further found that the effect of twisting and rotary chopping could be further increased by using low linear density fiber. Such additional effect was particularly substantial when chopping the fiber is short pieces, preferably 4 mm or less. Thus it is preferred to use fiber having a linear density less than 2000 dtex, and the fiber is preferably chopped to a length less than 4 mm.

The fibers that can be treated according to the present method include any aramid fiber, particularly continuous spun fiber and stretch broken yarn. Yarn titers are not important to the invention but are generally between 800 and 8050 dtex, more preferably between 1200 and 4830 dtex. Suitable aramid fibers include the meta- and para-aramid fibers, such as Teijinconex® fibers [poly-(meta-phenylene isophthalamide); MPIA], Twaron® fibers [poly(para-phenyleneterephthalamide); PPTA] and Technora® fibers [co-poly-(paraphenylene/3,4'-oxydiphenylene terephthalamide)]. Most commonly Twaron® fibers are used.

The fibers that are treated according to the method of the invention show strong interfilament cohesion properties, i.e. the fibers that are cut into small pieces have a low tendency to split into individual filaments. The chopped fibers of the invention therefore have a high bulk density and are easy to dose and disperse in extruders for making compounds with thermoplastic materials such as polyamide, polyoxymethylene, polycarbonate, polybuteneterephthalate, and the like.

The invention is further explained and the advantages are shown in the following non-restrictive illustrative examples.

Example 1

Aramid fiber (PPTA, Twaron®) 3360 dtex was impregnated with binding agent (Eastman LB-100, Eastman Chemical Company, Kingsport, USA), dried, and treated with an overlay finish (LW 245, Cognis, Düsseldorf, Germany). The fibers were then chopped in a Neumag rotary chopper at 100 mpm (meters per minute) to pieces of 6 mm and the bulk density was determined (Chopped fiber A was almost flat; according to prior art).

Bulk density was determined as follows:

Required Apparatus:

A round aluminum beaker having a contents of 1000 ml (inside diameter 10 cm, height 12.7 cm);

A balance (accuracy 0.01 gram)

A ruler

Weigh the aluminum beaker (a grams) and place it on a table. Fill the aluminum beaker with shortcut fibers from a height of about 10 cm. Add as much fibers till a fiber heap is formed. Remove the heap with the ruler by grazing over the top of the beaker. Weigh the filled aluminum beaker again (b grams).

During the determination, shaking the beaker or pressing onto the shortcut fibers should be prevented. The bulk density of the shortcut fibers is b-a grams. The test is carried out in duplicate and the average value is the bulk density of the fiber sample.

In the examples the quantity "bulk density ratio" is used. In example 1 this is the ratio between (the bulk density of the shortcut fiber sample×100)/(the bulk density of the shortcut fibers produced out of untwisted yarns). In example 2, this is the ratio between (the bulk density of the shortcut fiber sample×100)/(the bulk density of the short cut fibers produced out of yarns which were cut by guillotine). As a consequence, the bulk density ratio of the shortcut fibers produced out of untwisted yarns (example 1) and the bulk density ratio of the short cut fibers produced out of yarns which were cut by guillotine (example 2) is set at "100".

The process was repeated but prior to impregnating the fiber was twisted (Chopped fibers I was elliptical or almost round; according to the invention). The results are given in Table 1.

TABLE 1

| | A | I |
|---|---|---|
| Twisting level (tpm) | 0 | 50 |
| Binding agent (%) | 4.5 | 4.5 |
| Drying method | Air oven | Air oven |
| Finish (%) | 0.7 | 0.7 |
| Chopping (no. of threads) | 2 | 2 |
| Bulk density ratio | 100 | 117 |

The bulk density of chopped fiber that is twisted is higher than that of untwisted fiber. The twisted materials therefore can more easily, faster, and without clogging risk, be used for feeding extruders.

Example 2

Twisted aramid fiber (PPTA, Twaron®) 3360 dtex was impregnated with binding agent Eastman LB-100, dried, and treated with LW 245 as an overlay finish. The fibers were chopped into 6 mm shortcut fibers. One part of the fibers was cut using a Pierret guillotine chopper at 1.2 mpm (chopped fiber B; comparative) and another part was chopped using a Neumag rotary cutter at 120 mpm (chopped fiber II; invention). Chopped fibers B and II were both elliptical or almost round. The results are given in Table 2 and illustrate that when a rotary cutter is used shortcut fibers with a higher bulk density and yield can be produced.

TABLE 2

| | B | II |
|---|---|---|
| Twisting level (tpm) | 60 | 60 |
| Binding agent (%) | 4.0 | 4.0 |
| Drying method | Air oven | Air oven |
| Finish (%) | 0.6 | 0.6 |
| Chopping (tow, ktex) | 806 | 17 |
| Yield (Kg/hour) | 58 | 122 |
| Bulk density ratio | 100 | 116 |

Example 3

Twisted aramid fibers (PPTA, Twaron®) of 3360 (III) and 1680 dtex (IV) were impregnated with binding agent Eastman LB-100, dried, and treated with LW 245 as an overlay finish. The fibers were chopped to short cut fibers. The short cut fibers with a length of 1.5 mm and 3.3 mm were obtained by using a Neumag NMC 290H rotary cutter. The short cut fibers with a length of 6 mm were obtained by using a Fleissner rotary cutter. The results illustrate that short cut fibers with a higher bulk density can be produced when twisted feed yarn with a lower linear density is used.

TABLE 3

| | IIIa | IIIb | IIIc | IVa | IVb | IVc |
|---|---|---|---|---|---|---|
| Linear density feed yarn | | 3360 dtex | | | 1680 dtex | |
| Twisting level (tpm) | | 50 | | | 50 | |
| Binding agent (%) | | 4.3 | | | 6.0 | |
| Drying method | | Air oven | | | Air oven | |
| Finish (%) | | 0.8 | | | 2.5 | |
| Rotary cutter | Neumag | Neumag | Fleissner | Neumag | Neumag | Fleissner |
| Fiber length | 1.5 mm | 3.3 mm | 6 mm | 1.5 mm | 3.3 mm | 6 mm |

TABLE 3-continued

| | IIIa | IIIb | IIIc | IVa | IVb | IVc |
|---|---|---|---|---|---|---|
| Cutting speed (m/min) | 100 | 200 | 150 | 200 | 200 | 150 |
| Bulk density (grams) | 92 | 114 | 245 | 118 | 166 | 233 |

The invention claimed is:

1. A method for improving filament cohesiveness of chopped aramid fiber comprising impregnating a water-soluble or water-dispersible film-forming binding agent selected from the group consisting of a polyurethane, a sulfonated polyester resin, and a mixture thereof, into the fiber, drying the fiber, optionally applying a finish to the fiber, and then chopping the fiber to pieces of 1 to 16 mm length, wherein the fiber prior to impregnating with the binding agent is subjected to a twisting process to obtain a fiber having a twisting level of 10 to 80 tpm (turns per meter) and the chopping of the fiber is performed in a rotary chopper, wherein the chopping of the fiber improves bulk density of the fiber.

2. The method according to claim 1 wherein the twisting level is 20 to 80 tpm.

3. The method according to claim 1 wherein the twisting level is 30 to 80 tpm.

4. The method according to claim 1 wherein the fiber is poly-(para-phenylene terephthalamide) fiber.

5. The method according to claim 1 wherein the fiber is co-poly-(paraphenylene/3,4'-oxydiphenylene terephthalamide).

6. The method according to claim 1 wherein the fiber has a linear density less than 2000 dtex, and the fiber is chopped to a length of 1 mm to 4 mm.

* * * * *